US005874026A

United States Patent [19]

Pilsits, Jr. et al.

[11] Patent Number: 5,874,026

[45] Date of Patent: Feb. 23, 1999

[54] METHOD OF FORMING CORROSION INHIBITING FILMS WITH HYDROGENATED BENZOTRIAZOLE DERIVATIVES

[75] Inventors: John P. Pilsits, Jr.; Ann M. Cognetti, both of Pittsburgh; Jasbir S. Gill, McKees Rocks, all of Pa.

[73] Assignee: Calgon Corporation, Pittsburgh, Pa.

[21] Appl. No.: 982,049

[22] Filed: Dec. 1, 1997

[51] Int. Cl.[6] ..... C23F 11/14; C23F 11/10

[52] U.S. Cl. ..... 252/394; 252/390; 422/14; 422/16; 210/696; 210/698

[58] Field of Search ..... 252/394; 422/14, 422/16

[56] References Cited

U.S. PATENT DOCUMENTS

| | | | |
|---|---|---|---|
| 2,861,078 | 11/1958 | Miller et al. | 260/308 |
| 4,338,209 | 7/1982 | Manabe et al. | 252/75 |
| 4,363,913 | 12/1982 | Clark et al. | 548/164 |
| 4,406,811 | 9/1983 | Christensen et al. | 252/180 |
| 4,744,950 | 5/1988 | Hollander | 422/16 |
| 4,765,158 | 8/1988 | Goller et al. | 66/168 |
| 4,873,139 | 10/1989 | Kinosky | 428/341 |
| 5,217,686 | 6/1993 | Vanderpool et al. | 422/16 |
| 5,219,523 | 6/1993 | Vanderpool et al. | 422/16 |
| 5,236,626 | 8/1993 | Vanderpool et al. | 252/394 |

*Primary Examiner*—Ellen M. McAvoy
*Attorney, Agent, or Firm*—Webb Ziesenheim Bruening Logsdon Orkin & Hanson, P.C.

[57] ABSTRACT

A method of use of a composition including either or both isomers of hydrogenated methylbenzotriazole, namely, 5-Methyl-1H-Benzotriazole or 4-Methyl-1H-Benzotriazole which have been at least about 50% hydrogenated, to form corrosion inhibiting films on metal surfaces in an aqueous environment. The hydrogenated methylbenzotriazole compositions provide both improved passivation and improved film persistence when charged to aqueous industrial systems either on a continuous or on an intermittent basis. Continuous dosing is generally kept at a constant >0.5, typically 1–2 ppm in the aqueous system to be treated; intermittent doses are generally 10–20 ppm once every week or two or more. Beyond the improved characteristics described above, films formed from the inventive composition also reduce spiking in corrosion rates immediately following halogen addition; foster faster return to pre-halogenation corrosion rates post-halogenation; and reduce the rate of conversion of phosphonate to orthophosphate, which reduces scale potential. For these reasons, the present compositions are either continuously or intermittently fed and effective to inhibit corrosion of copper and copper alloy surfaces subjected to alkaline, neutral or slightly acidic aqueous systems.

21 Claims, 7 Drawing Sheets

Nonhydrogenated Structure

Hydrogenated Structure

R = alkyl group with general formula $C_n H_{2n+1}$
where n = 1-8

R = alkoxy group with general formula ( $C_n H_{2n+1}$) 0
where n = 1-6

Nonhydrogenated Structure

Hydrogenated Structure

R = alkyl group with general formula $C_n H_{2n+1}$
where n = 1-8

R = alkoxy group with general formula ( $C_n H_{2n+1}$) 0
where n = 1-6

5- Methyl- 1H- Benzotriazole
( MW = 133.15 g/mole )

4- Methyl- 1H- Benzotriazole
( MW = 133.15 g/mole )

Hydrogenated 5- Methyl- 1H- Benzotriazole
( MW = 137.19 g/mole )

Hydrogenated 4- Methyl- 1H- Benzotriazole
( MW = 137.19 g/mole )

METHOD OF FORMING CORROSION INHIBITING FILMS WITH HYDROGENATED BENZOTRIAZOLE DERIVATIVES

FIELD OF THE INVENTION

The invention relates to hydrogenated tolyltriazole derivatives for use in treating the inside surfaces of copper and copper alloy pipes, in an aqueous environment, to enhance corrosion inhibition of copper and its alloys.

BACKGROUND OF THE INVENTION

Benzotriazole, including mercaptobenzothiazole and tolyltriazole, are known copper corrosion inhibitors, as documented for example in U.S. Pat. No. 4,675,158 which discloses tolyltriazole/mercaptobenzothiazole compositions as corrosion inhibitors. Similarly, U.S. Pat. No. 4,744,950 discloses the use of lower (3–6 carbon) alkylbenzotriazoles as corrosion inhibitors. U.S. Pat. No. 4,338,209 identifies metal corrosion inhibitors containing one or more of mercaptobenzothiazole, tolyltriazole and benzotriazole. Additional triazole corrosion inhibitor patents include U.S. Pat. Nos. 4,406,811, 4,363,913, 2,861,078, and, possibly most notably, U.S. Pat. No. 5,217,686, the latter of which is directed to a composition containing a tolyltriazole or a derivative thereof in admixture with a $C_3$–$C_{12}$ alkoxybenzotriazole. U.S. Pat. Nos. 5,219,523 and 5,236,626 issued on continuation and divisional applications, respectively, of the application which eventuated U.S. Pat. No. 5,217,686. Related prior art includes U.S. Pat. No. 4,873,139, which discloses the use of 1-Phenyl-1H-Tetrazole-5-Thiol to prepare corrosion resistant silver and copper surfaces. Chemical Abstract CA 95(6) :47253 (1979) similarly discloses the use of 1-Phenyl-5-Mercaptotetrazole to inhibit the corrosion of carbon steel in nitric acid solutions.

In general, benzotriazole and its derivatives of these types and their performance in industrial water systems are judged by their passivation and persistency characteristics. "Passivation" refers to the formation of a film which lowers the corrosion rate of the metallic surface being treated, usually by continuously or intermittently charging a dose of the film forming material directly into the water of the system to be treated. "Passivation rate" thus refers to the time required to form a protective film on a metallic surface, and "persistency" refers to the length of time a protective film is present on a metallic surface when a corrosion inhibitor is not present in an aqueous system which is in contact with the protected metallic surface. Improved film persistence is acknowledged as one of the most important criteria for film-forming corrosion inhibitors of this type, in view of the economic and ecologic advantages of the commensurate low dose or charge required for materials that can attain it. Passivation rate is also important for the same reasons. In other words, those materials whose corrosion inhibiting films are the most valuable of all are those which both form quickly, thus minimizing the presence of the material in the effluent, and which persist for greatest length of time, likewise minimizing the need to charge the material to the system. The present compositions provide such an improvement in that they give enhanced passivation at improved passivation rates and also improved film persistence over benzotriazole and its derivatives similarly employed in the prior art.

SUMMARY OF THE INVENTION

The present invention is the method of use of a composition containing either one or any of the isomers of hydrogenated methylbenzotriazole which have been at least about 50% hydrogenated, to form corrosion inhibiting films on the inside metal surfaces of industrial water system pipes. The hydrogenated methylbenzotriazole compositions provide both improved passivation and improved film persistence when charged to aqueous industrial systems either on a continuous or on an intermittent basis. Continuous dosing is generally kept at a constant 0.5–5 ppm in the aqueous system to be treated; intermittent doses are generally 5–50 ppm once every week or two or more. Beyond the improved characteristics described above, films formed from the inventive composition also reduce spiking in corrosion rates immediately following halogen addition; foster faster return to pre-halogenation (chlorine, bromine, etc.) corrosion rates post-halogenation; and reduce the rate of conversion of phosphonate to orthophosphate, which reduces scale potential. For this reason, the present compositions are effective to inhibit corrosion of copper and its alloys subjected to alkaline, neutral or slightly acidic aqueous systems. Finally, the compositions have particular utility in admixture with compositions such as those disclosed in U.S. Pat. No. 5,217,686, as well as when used alone.

DETAILED DESCRIPTION OF THE INVENTION

Figure 1:
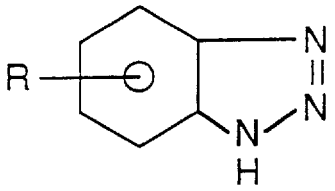
FIG. 1 represents the generic structures of the hydrogenated (bottom) and the nonhydrogenated (top) compositions addressed in this specification.
Figure 1:
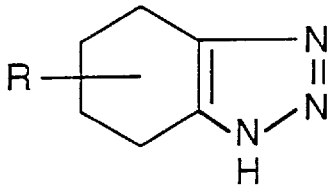
Figure 2A:
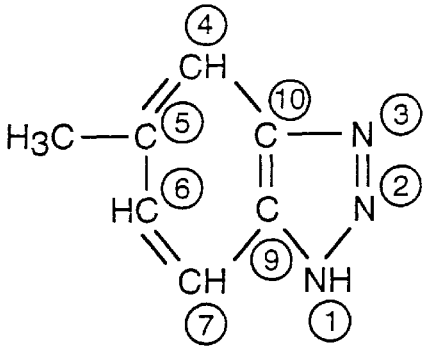
FIG. 2 illustrates the two common isomeric constituents of the present composition in both nonhydrogenated (top) and hydrogenated (bottom) form.
Figure 2B:
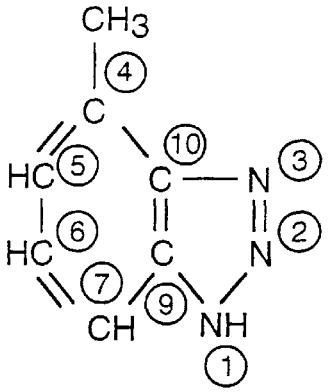
Figure 2C:
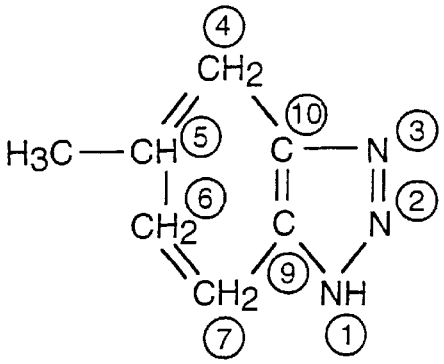
Figure 2D:
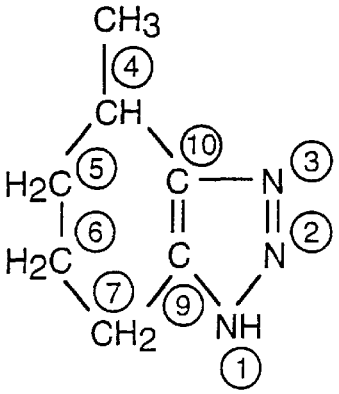

Treatment of aqueous systems—such as cooling water systems—which contact copper or copper alloy surfaces, such as aluminum brass, admiralty brass or 90/10 copper/nickel, requires the use of specific copper inhibitors. These inhibitors: (1) minimize the corrosion of the copper or copper alloy surfaces, including general corrosion, dealloying and galvanic corrosion; and (2) minimize problems of galvanic "plating out" of soluble copper ions onto iron or aluminum. Regarding the latter, soluble copper ions can enhance the corrosion of iron and/or aluminum components in contact with aqueous systems. This occurs through the reduction of copper ions by iron or aluminum metal, which is concomitantly oxidized, resulting in the "plating-out" of copper metal onto the iron surface. This chemical reaction not only destroys the iron or aluminum protective film but creates local galvanic cells which can cause pitting corrosion of iron or aluminum. Most of the prior art benzotriazole derivatives other than those of the present invention, when used to inhibit copper corrosion of these types, typically had to be fed continuously because of the limited durability of protective films deposited therefrom.

Against this background, the present invention is a method of use of an improved corrosion inhibiting composition containing 4, 5, 6 or 7 isomer or any combination thereof of hydrogenated methylbenzotriazole, which have been at least about 50% hydrogenated, i.e., the application of such a composition to the inside metal surfaces of industrial water system pipes to reduce their corrosion. The invention also embraces aqueous compositions containing water, particularly cooling water, in admixture with 0.5–50 ppm of the above-described composition. The hydrogenated methylbenzotriazole compositions provide both improved passivation and improved film persistence when charged to aqueous industrial systems either on a continuous or on an intermittent basis.

As a matter of linguistic usage, this specification uses both terms "tolyltriazole" and "methylbenzotriazole" which, strictly speaking, are synonyms. For ease of distinction, however, this specification refers to the derivatives of the prior art as "tolyltriazole" derivatives and those used in the inventive method as "methylbenzotriazoles," to help to distinguish them. This mechanism of syntax is not meant to obscure that it is predominantly the hydrogenation feature disclosed herein which is believed to represent an important element of the inventive step. The hydrogenation reaction per se is well known and within the skill of the art; an exemplary patent disclosing it is DE 1948794.

Continuous dosing of the present compositions is generally kept at a constant 0.5–5 ppm, preferably 1–2 ppm in the aqueous system to be treated; intermittent doses are generally 5–50 ppm, preferably 10–20 ppm, once every week or two or generally even anywhere between several days to several months. Apart from these general values, however, it should be borne in mind that the compositions are intended to be used in any amount effective to achieve the intended purpose, namely, to inhibit corrosion to the desired degree in a given aqueous system, and maximum concentrations are determined more by economic than functional considerations. The maximum economic concentration will generally be determined by cost of alternative treatments of comparable effectiveness, if comparable treatments are available. Cost factors include, but are not limited to, the total through-put of the system to be treated, the costs of treating or disposing of the discharge, inventory costs, feed-equipment costs, and monitoring costs. On the other hand, minimum concentrations are ultimately determined based upon operating conditions such as pH, total and dissolved solids, biocide used, whether the surface to be treated is copper or its alloys, temperature, and etc.

Intermittent feed provides benefits relative to ease of monitoring and environmental impact, and also lowers the average amount of the composition required to achieve the same passivation and film persistence as continuous feed with a total greater charge over the same period of time. Improved passivation seen with the inventive composition regardless of continuous versus intermittent feed allows operators more flexibility in providing the contact required to form a durable film, and the ability to passivate in high-solids, particularly high dissolved solids, waters. This in turn allows operators to improve corrosion inhibition in an extended selection of water qualities in a concomitantly expanded selection of industrial systems.

Various embodiments of the inventive composition are characterized by their degree of hydrogenation as well as the ratio in which the two methylbenzotriazole isomers are combined. In a first embodiment of the invention, nearly all of a quantity of 5-Methyl-1H-Benzotriazole is hydrogenated, with the quantity making up about 50% of a 60:40 admixture wherein the remaining 50% contains 8 parts hydrogenated 4-Methyl-1H-Benzotriazole and 2 parts nonhydrogenated 4-Methyl-1H-Benzotriazole. In a second embodiment, 80% of a quantity of 5-Methyl-1H-Benzotriazole is hydrogenated, with that quantity making up about 50% of a 60:40 admixture wherein the remaining 50% contains about 4 parts hydrogenated 4-Methyl-1H-Benzotriazole and about 6 parts nonhydrogenated 4-Methyl-1H-Benzotriazole. In a third embodiment, 70% of a quantity of 5-Methyl-1H-Benzotriazole is hydrogenated, with that quantity making up about 50% of a 60:40 admixture wherein the remaining 50% contains about 6 parts hydrogenated 4-Methyl-1H-Benzotriazole and about 4 parts nonhydrogenated 4-Methyl-1H-Benzotriazole. In a fourth embodiment, 50% of a quantity of 5-Methyl-1H-Benzotriazole is hydrogenated, with that quantity making up about 50% of a 50:50 admixture wherein the remaining 50% contains about 6 parts hydrogenated 4-Methyl-1H-Benzotriazole and about 4 parts nonhydrogenated 4-Methyl-1H-Benzotriazole. In any case, in general the inventive composition contains one of the 4, 5, 6 or 7 isomer or any of their combination, with at least about 50% of either or all isomers having been hydrogenated prior to preparation of the admixture. By "one or the other isomer or their combination" it is meant that the isomers may be admixed in ratios between 0:100 to 100:0, preferably between about 1:10 to 10:1, more preferably between about 2:8 to 8:2, most preferably between about 6:4 to 4:6. The chemical structures for the nonhydrogenated and hydrogenated isomers described herein are illustrated in FIGS. 1 and 2.

The instant compositions may be prepared simply by blending the constituent compounds or by blending the precursors and hydrogenating them together. Initial hydrogenation of the methylbenzotriazole isomers is accomplished by hydrogenation protocols known in the art, such as are disclosed in German Patent DE 1,948,794. DE 1,948,794 discloses acid hydrogenation reactions in the presence of a catalyst such as Pd, Rh or Pt for various benzotriazoles. Moreover, commercially available liquid blends of the two hydrogenated isomers are available under such trade names as Cemazol WD-85 available from CEMCO, Inc. A similar if not identical commercial product is available under the product name "COBRATEC 928," available from PMC. The inventive hydrogenated methylbenzotriazole compositions of the present invention are water soluble and/or water dispersible.

It should also be noted that the substitution of the benzotriazole need not necessarily be methyl, although in the preferred embodiments of the invention the substitution is methyl. Because it is the hydrogenation aspect of the invention which is believed to be central, not the methyl substitution, the inventive method also embraces the use of hydrogenated benzotriazoles substituted in the 5- or 4-position with general formulas shown in FIG. 1, comprising methyl, butyl-, pentoxy-, heptyl-, octyl-, and pentyl-substituted moieties. In general, the hydrogenated methyl-substituted benzotriazoles are commercially available and thus important in the commercialization of this invention, however, it is important that it be understood that the present method is not limited to the methyl-substituted hydrogenated isomers and their use as corrosion inhibitors.

Beyond the improved characteristics described above, films formed from the inventive composition also (1) reduce spiking in corrosion rates immediately following halogen addition; (2) foster faster return to pre-halogenation corrosion rates post-halogenation; and (3) reduce the rate of conversion of phosphonate to orthophosphate, which reduces scale potential. For this reason, the present compositions are effective to inhibit corrosion of both copper and copper alloy surfaces subjected to aqueous systems.

It is important to note that the inventive compositions have utility in admixture with compositions such as those disclosed in U.S. Pat. Nos. 5,217,686, 5,219,523 and 5,236,626, incorporated herein by reference, as well as when used alone. The composition containing hydrogenated methylbenzotriazoles as described herein (or hydrogenated nonmethyl equivalents) may be admixed in virtually any proportion with the benzotriazole compositions of these three U.S. Patents and, in so doing, will improve the passivation rates and film persistence of the compositions disclosed therein. One reason why the admixture approach is important is that the hydrogenated benzotriazole derivatives are generally more expensive than the nonhydrogenated ones. Hence, in applications where only a portion of the corrosion inhibiting amount of benzotriazole need be hydrogenated benzotriazole, in order to achieve the desired results, economic factors will dictate that such an approach be used.

The present compositions can be used as water treatment additives for industrial cooling water systems, gas scrubber systems or any water system which is in contact with a metallic surface, particularly surfaces containing copper and/or copper alloys. They can be fed alone or as part of a treatment package which includes without limitation biocides, scale inhibitors, dispersants, defoamers and/or other corrosion inhibitors.

The following examples are offered further to amplify the disclosure provided above with particular examples and illustrative test results. The examples are not to be considered as limiting the scope of the invention in any way, however, and primarily they demonstrate the effectiveness of the instant protocols in the inhibition of corrosion of copper and its alloys.

EXAMPLE 1

The test cell used consisted of an 8-liter vessel fitted with an air dispersion tube, a heater-temperature circulator, and a pH control device. The temperature was regulated at 50±2 degrees C. The pH was automatically controlled by the addition of house air and carbon dioxide mixture to maintain the designated pH with ±0.1 pH units. Air was also continually sparged into the cell to maintain air saturation. Water lost by evaporation was replenished by deionized water as needed.

Corrosion rates were determined in two (2) distinct waters. The compositions of the test waters, as made up in 180 L tanks, were "BIW" water, or "Basic Industrial Water," and "Alamito water." BIW contained about 264 mg/L calcium ion, about 117 mg/L magnesium ion, about 40 mg/L sodium ion, about 468 mg/L chloride ion, about 476 mg/L sulfate ion, about 9.2 mg/L silicon dioxide and about 0.5 mg/L hydroxyethylidenediphosphonic acid (HEDP). The Alamito water contained about 281 mg/L calcium ion, about 182 mg/L magnesium ion, about 6688 mg/L sodium ion, about 4597 mg/L chloride ion, about 9307 mg/L sulfate ion, about 130 mg/L silicon dioxide, about 0.5 mg/L HEDP, about 261 mg/L potassium ion, about 3.2 mg/L phosphate ion and about 6.5 mg/L TRC-233, a copolymer of acrylic acid and 2-acrylamido-2-methylpropyl sulfonic acid. The Alamito water was a higher solids, more "aggressive" water (from the standpoint of corrosion potential) than the Basic Industrial Water. These test water compositions are summarized in Table I, below. The hydroxyethylidenediphosphonic acid and TRC-233 are additives which prevent calcium carbonate and other precipitation during the testing procedure.

TABLE I

Water Composition Used in Example 1

| Water Designation | Ion | Concentration (mg/L) |
|---|---|---|
| BIW | $Ca^{++}$ | 264 |
| | $Mg^{++}$ | 117 |
| | $Na^{+}$ | 40 |
| | $Cl^{-}$ | 468 |
| | $So_4^{--}$ | 476 |
| | $SiO_2$ | 9.2 |
| | HEDP | 0.5 |
| Alamito | $CA^{++}$ | 281 |
| | $MG^{++}$ | 182 |
| | $NA^{+}$ | 6688 |
| | $Cl^{-}$ | 4597 |
| | $SO_4^{--}$ | 9307 |
| | $SiO_2$ | 130 |
| | HEDP | 0.5 |
| | $K^{+}$ | 261 |
| | $F^{-}$ | 18 |
| | $PO_4^{3-}$ | 3.2 |
| | TRC-233 | 6.5 |

Corrosion rates were determined using the PAIR™ Probe (polarization admittance instantaneous rate) method. Instantaneous corrosion rates in mpy (mils-per-year) were measured with a Petrolite Model M-1010 corrosion rate monitor. PAIR™ probe tips, or electrodes, made of 90/10 copper/nickel were placed into the cells and the corrosion rate measured periodically over a period of 10–12 days. Four cell tests, two with each type of water, were conducted as follows.

Figure 3A:
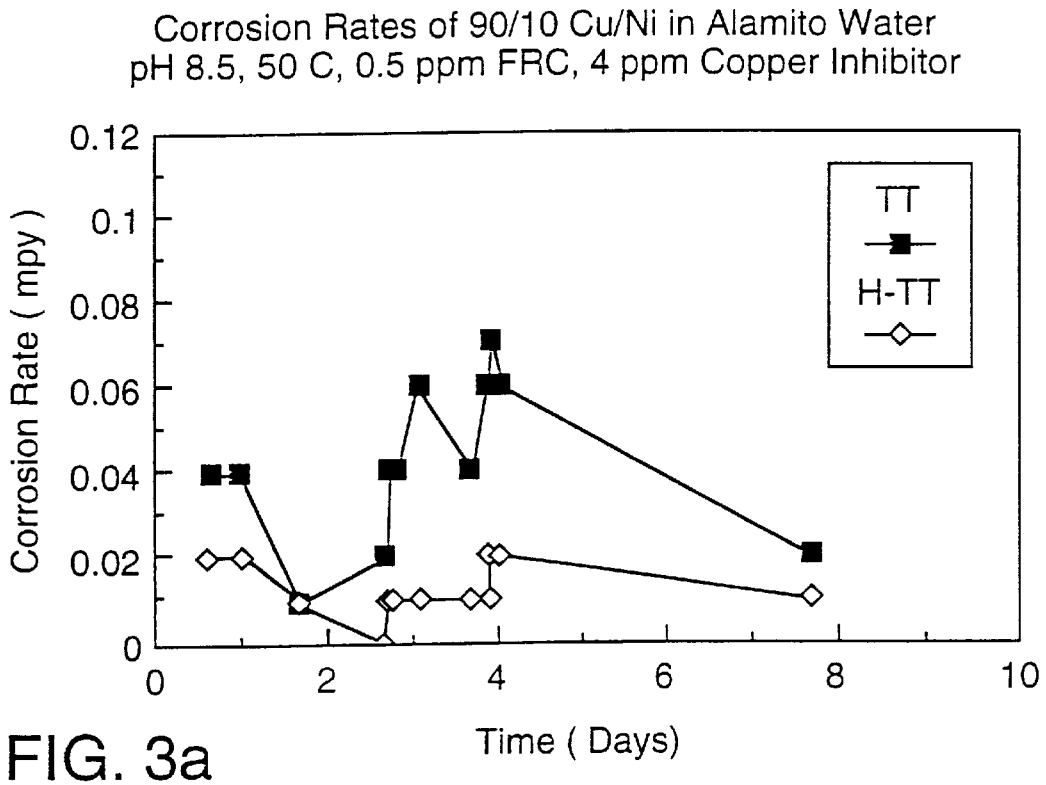
FIGS. 3*a* and 3*b* are a comparison of the use of hydrogenated methylbenzotriazoles ("H-TT") with prior art tolyltriazoles ("TT") in aqueous systems and the contrasted corrosion rates in two representative different types of water, "BIW," or "Basic Industrial Water," and "Alamito" water, as described further in Example 1.
Figure 3B:
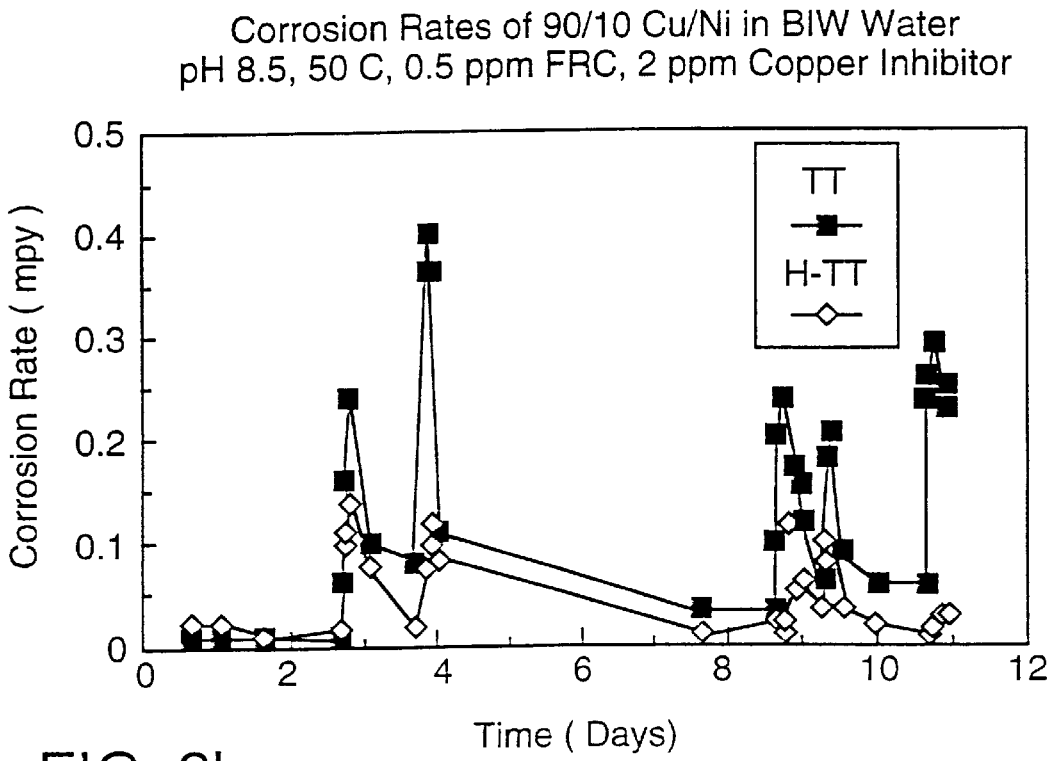

Cells were filled with one of the above-described two types of water and corrosion rates of a pair of 90/10 Copper/Nickel electrodes charged thereto were measured over the test period. Continuously over the 10–13 day period, a constant presence of 4 ppm of "H-TT," hydrogenated methylbenzotriazole, commercially available from CEMCO, Inc. as Cemazol H-TT, or nonhydrogenated tolyltriazole ("TT") was provided to each of the Alamito water samples in two separate cells; a continuous presence of 2 ppm nonhydrogenated tolyltriazole ("TT") or hydrogenated methylbenzotriazole (H-TT) was charged to each of the water types in the third and fourth test cells containing "BIW" water. The corrosion rates in mpy (mils-per-year) (% inhibitor efficiency) over the 10–13 days of the test are shown in graphic form in FIGS. 3*a* and 3*b*, respectively. The results show that the hydrogenated methylbenzotriazole corresponded to significantly lower corrosion rates compared to nonhydrogenated tolyltriazole especially during and after the addition of halogen (contemporaneously with the "spiking" of the "TT" values shown). Films formed with the present hydrogenated methylbenzotriazoles were thus determined to give better corrosion inhibition than did the nonhydrogenated tolyltriazoles of the prior art, particularly immediately after halogen addition.

EXAMPLE 2

Figure 4:
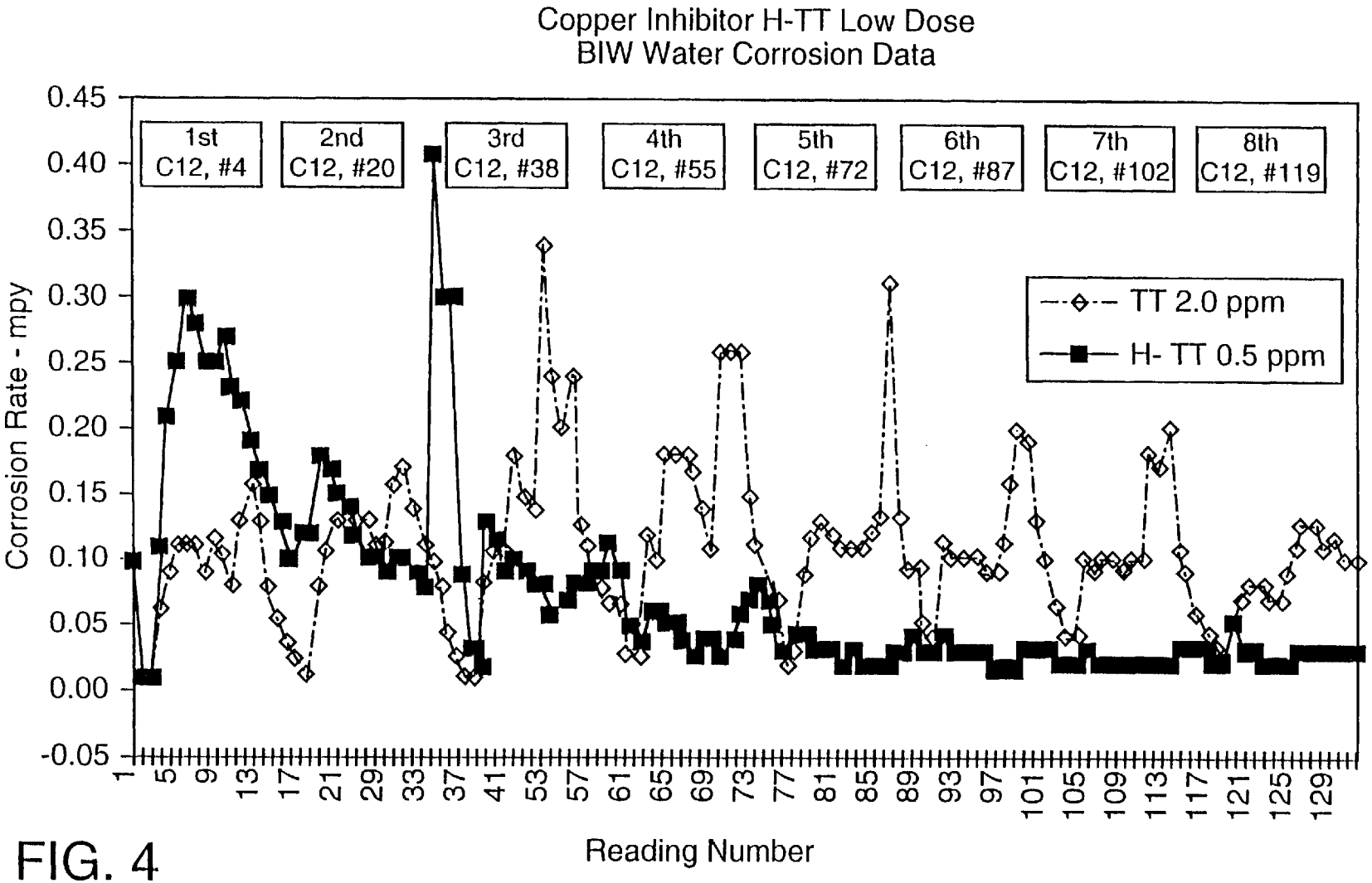
FIG. 4 is a line graph showing the comparative corrosion rates of the prior art methyltolyltriazole as contrasted with the "H-TT" hydrogenated methylbenzotriazole as used in the present method.

The cell tests of Example 1 were repeated, this time by comparing continuous presence of 2 ppm tolyltriazole with continuous feeding of 0.5 "H-TT" in Basic Industrial Water as described above. The corrosion rate in mpy was measured in accordance with the same equipment and protocols as described in Example 1 over a period of 14 days during which eight halogenations were performed in sequence. The data are presented in line graphic form in FIG. 4. It is evident from FIG. 4 that not only did the hydrogenated methylbenzotriazole (H-TT) give better overall corrosion resistance at one-fourth the dose of nonhydrogenated tolyltriazole (TT), it further resulted in improved extinction of post-halogenation corrosion "spiking" over time.

EXAMPLE 3

Figure 5:
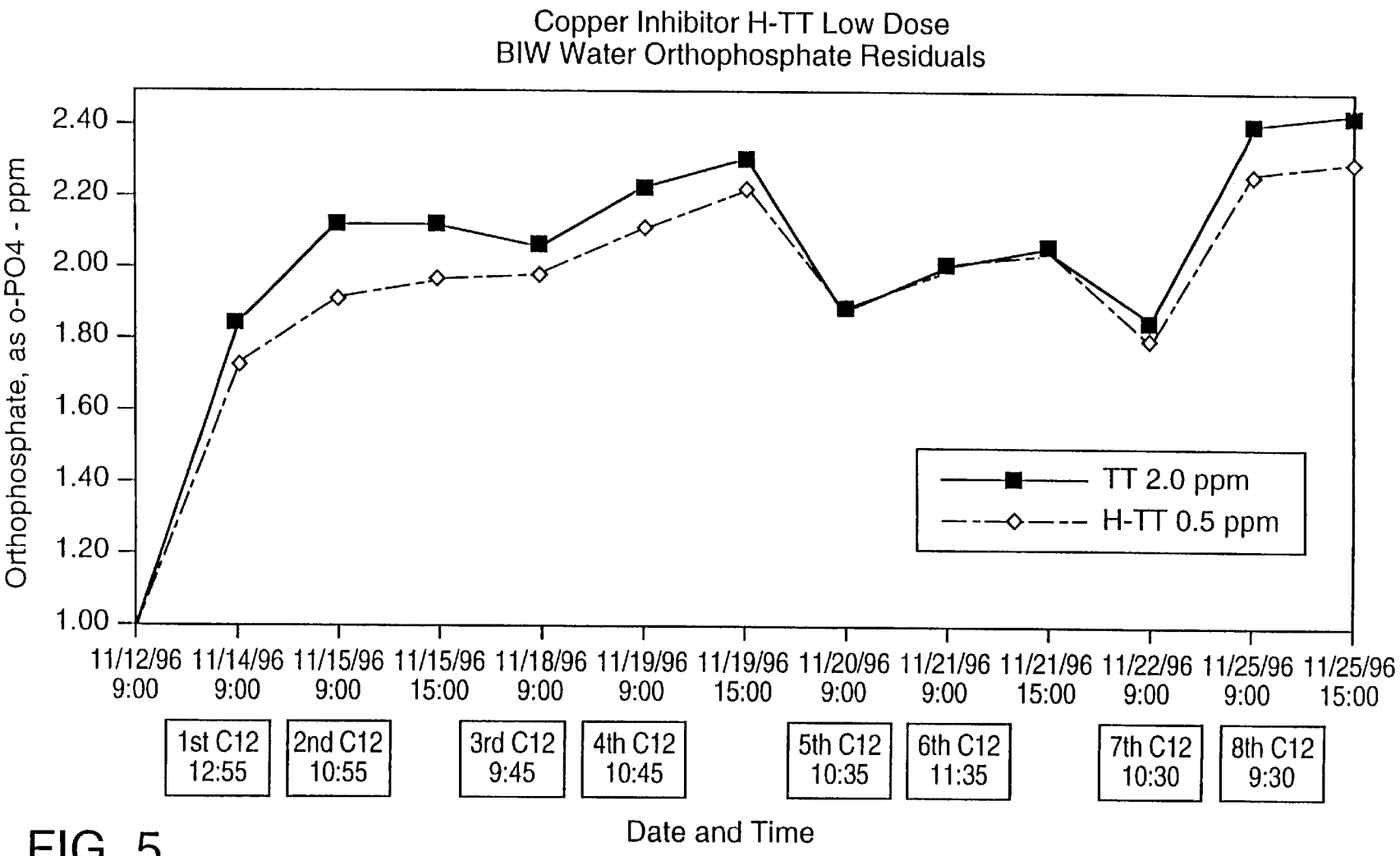
FIG. 5 is a line graph showing the presence of orthophosphate residuals in "BIW" water in the presence of either of the prior art methyltolyltriazole as contrasted with "H-TT."

Comparative tests were performed to assess the ability of the hydrogenated tolyltriazoles of the present invention to reduce the rate of conversion of phosphonate to orthophosphate in Basic Industrial Water (see Example 1). As shown in the test results of FIG. 5, a line graphic comparison of 2.0 ppm tolyltriazole and 0.5 ppm H-TT (see Example 2), identifies the ability of 0.5 ppm hydrogenated methylbenzotriazole to reduce the conversion of phosphonate to orthophosphate compared to the TT. Based on this premise the potential for calcium phosphate scale formation is significantly reduced.

EXAMPLE 4

Figure 6:
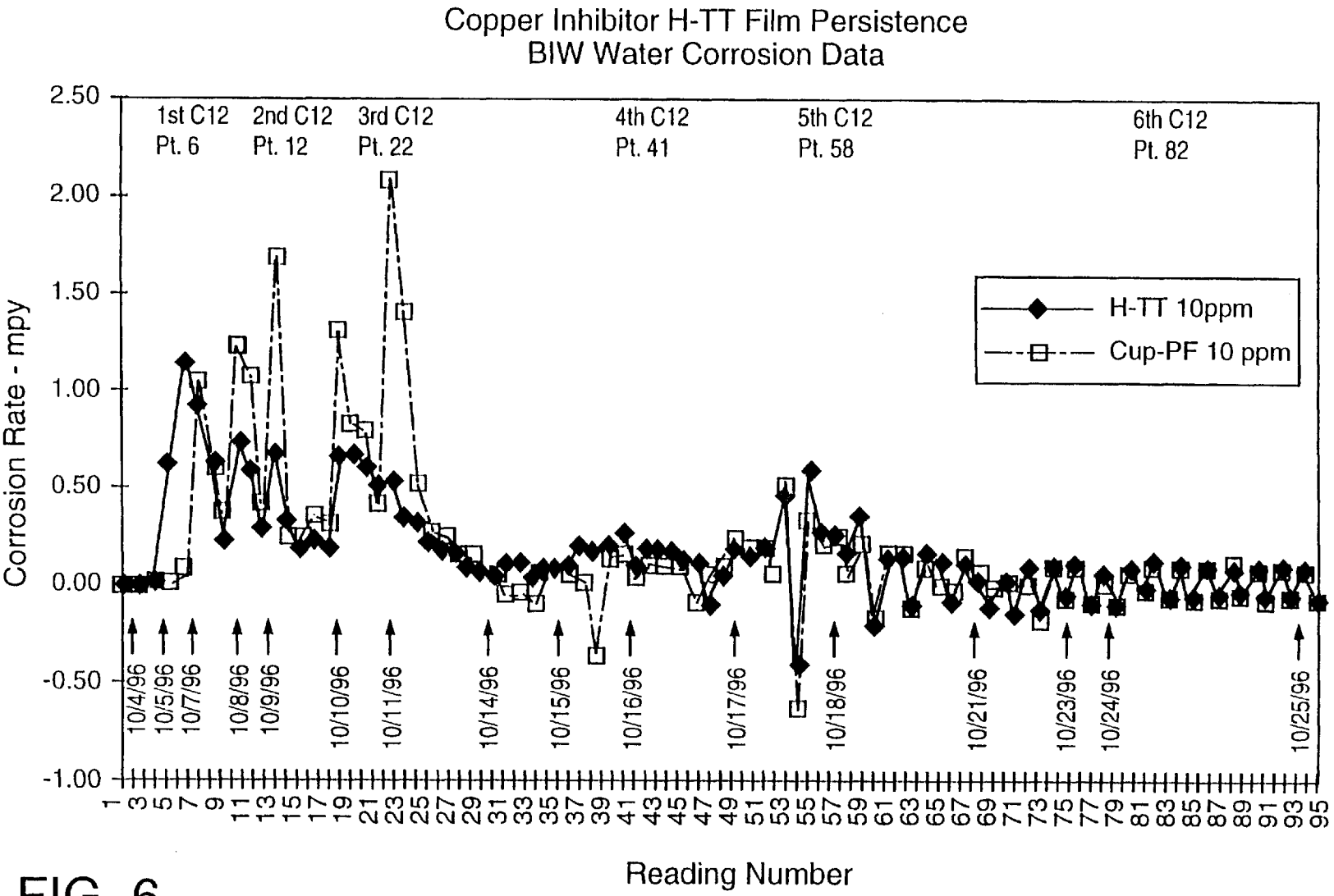
FIG. 6 is a line graph showing the comparative abilities of the prior art tolyltriazole and the present hydrogenated benzotriazoles to reduce conversion of organic phosphonate to orthophosphate.

The 8-L. Cell tests of Example 1 were repeated, this time by comparing intermittent presence of 10 ppm of Cuprostat-PF®, a known "film persistent" copper inhibitor, with intermittent presence of 10 ppm H-TT in Basic Industrial Water ("BIW"). To the cells filled with "BIW" water, copper inhibitor and corrosion coupons and PAIR™ probe tips were added. After two days the corrosion coupons and probe tips were removed and then placed into fresh BIW water without copper inhibitor for an additional two days prior to the start of halogenation. The corrosion rate in mpy (mils-per-year) was measured in accordance with the same equipment and protocols as described in Example 1. The duration of this test extended over a period of time during which six halogenations, and six fresh BIW water changeovers without copper corrosion inhibitor, were performed in sequence over 12 days. The PAIR™ probe data is presented in graphical form in FIG. 6. It is evident from FIG. 5 that the films formed with the hydrogenated methylbenzotriazole gave improved persistent corrosion inhibition and reduced spiking during the first three halogenations. Equal inhibition, with substantially reduced spiking versus the initial three days, was also maintained for the remainder of the test. Thus, film persistent properties are exhibited when H-TT is applied on an intermittent basis. An added benefit in this case is that H-TT provides this protection by itself and at lower overall cost as compared to other blends of film persistent azoles.

EXAMPLE 5

The test cells used were the same as described in Example 1 except that the pH was regulated at 7.6±0.1 pH units. This test studied mixtures of H-TT (hydrogenated methylbenzotriazole) and TT (nonhydrogenated tolyltriazole) ranging from 100% to 0% (H-TT/TT) and 0% to 100% (H-TT/TT) in Synthetic RCW. The Synthetic RCW water is described in Table II. The water contained about 420 mg/L calcium ion, about 160 mg/L magnesium ion, about 352.5 mg/L sodium ion, about 1.7 mg/L hydrogen ion (added as $H_2SO_4$), about 140 mg/L chloride ion, about 2100 mg/L sulfate ion, about 97.7 mg/L bicarbonate ion, about 48 mg/L silicon dioxide, about 8.7 mg/L orthophosphate, about 1.2 mg/L SHMP as $PO_4^{-3}$, about 1.0 mg/L HEDP as $PO_4^{-3}$, and about 7.3 mg/L TRC-233 (a copolymer of acrylic acid and 2-acrylamido-2-methylpropyl sulfonic acid).

Figure 7:
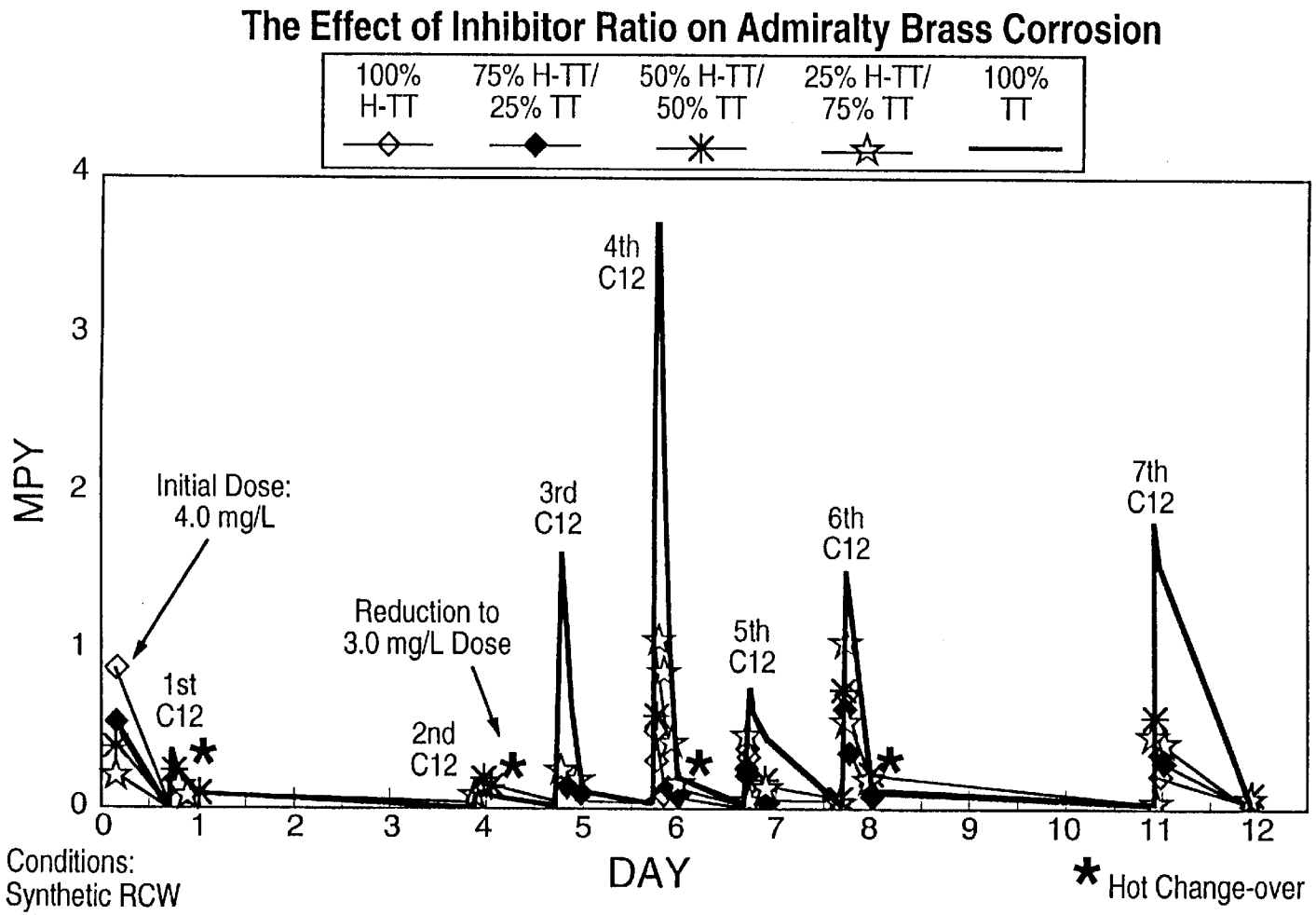
FIG. 7 is a line graph showing the comparative corrosion rates of various admixtures of inhibitor compositions according to the invention.

Corrosion rates were monitored using Admiralty 443 (CDA-443) PAIR™ probe tips. Five (5) 8-L. cells were filled with the Synthetic RCW and then the copper corrosion inhibitors were added as follows: 100% H-TT, 100% TT, or an H-TT/TT mixture was added to an individual cell as follows: 75/25% H-TT/TT, 50/50% H-TT/TT, or 25/75% H-TT/TT. The initial dosage of each inhibitor alone or its mixture was 4 mg/L. Each water was then brought to 50 degrees C and a pH of 7.6. The PAIR™ probe tips were then placed into each cell. The corrosion rates, measured in mils/year, were monitored for a period of 12 days, using the same equipment and protocols as discussed in Example 1. Daily chlorinations were conducted using NaOCl to attain a free halogen residual of 0.5 mg/L. There were seven daily chlorinations performed during the course of the 12 day test. Hot changeovers of the metallurgy into fresh RCW water and fresh inhibitors were performed every 2–3 days. The PAIR™ data are presented in the graph in FIG. 7.

It was apparent after the first chlorination on day 1, and through day 3, that all of the inhibitors and their mixtures were controlling the corrosion spikes at an almost unmeasurable level. In order to better determine the impact of the inhibitors, their mixtures, and the dosage on corrosion spiking, it was decided to reduce the dosages to 3 mg/L in each of the cells on day 4. Chlorinations and changeovers were performed as noted on the graph. The data clearly show that after day 4 the mixtures greatly reduced the corrosion spiking versus TT alone. As was evidenced in Example 4 and FIG. 6, the HTT and its mixtures in this Example 5 provide the same improved corrosion control over time.

An added benefit derived from this approach of using variable mixtures of H-TT and TT is that of controlling the economics of a given application, based on the performance required, while providing all of the here-to-for mentioned benefits in the previous Examples of using H-TT versus TT alone.

Water Composition Used in Example 5

| Water Designation | Ion | Concentration (mg/L) |
|---|---|---|
| Synthetic RCW | $Ca^{+2}$ | 420 |
| | $Mg^{+2}$ | 160 |
| | $Na^{+1}$ | 352.5 |
| | $H^{+1}$ | 1.7 |
| | $Cl^{-1}$ | 140 |
| | $So_4^{-2}$ | 2100 |
| | $HCO_3^{-1}$ | 97.7 |
| | $SiO_2^{-2}$ | 48 |
| | $PO_4^{-3}$ | 8.7 |
| | SHMP, as $PO_4^{-3}$ | 1.2 |
| | HEDP, as $PO_4^{-3}$ | 1.0 |
| | TRC-233 | 7.3 |

Although the invention has been described particularly above, in connection with specific examples and other details, the invention is only to be limited insofar as is set forth in the accompanying claims.

We claim:

1. A method of inhibiting corrosion in an aqueous system which is in contact with a metallic surface, comprising adding to said system an effective amount of at least one hydrogenated benzotriazole derivative.

2. A method of inhibiting corrosion in an aqueous system which is in contact with a metal surface, comprising adding to said system an effective amount of a composition containing as a portion thereof at least one hydrogenated alkyl-substituted or alkoxy-substituted benzotriazole.

3. The method according to claim 2 wherein the effective amount of said composition is added on a continuous basis.

4. The method according to claim 2 wherein the effective amount of said composition is added on an intermittent basis.

5. The method according to claim 2 wherein said hydrogenated alkyl-substituted or alkoxy-substituted benzotriazole is at least 50% hydrogenated and further wherein said alkyl moiety is selected from the group consisting of methyl, ethyl, butyl, propyl, pentoxy, heptyl, octyl and pentyl.

6. The method according to claim 5 wherein said alkyl moiety is methyl.

7. The method according to claim 6 wherein said alkyl moiety is methyl in either the 5- or the 4-position.

8. The method according to claim 7 wherein said composition comprises an admixture of 5- and 4-Methyl hydrogenated benzotriazoles.

9. The method according to claim 8 wherein said composition comprises approximately a 60:40 admixture of 5-Methyl-1H-Benzotriazole and 4-Methyl-1H-Benzotriazole and further wherein said 5-Methyl-1H-Benzotriazole is at least 70% hydrogenated.

10. The method according to claim 8 wherein said composition comprises approximately a 60:40 admixture of 5-Methyl-1H-Benzotriazole and 4-Methyl-1H-Benzotriazole and further wherein said 5-Methyl-1H-Benzotriazole is at least 80% hydrogenated.

11. The method according to claim 8 wherein said composition comprises approximately a 60:40 admixture of 5-Methyl-1H-Benzotriazole and 4-Methyl-1H-Benzotriazole and further wherein said 5-Methyl-1H-Benzotriazole is nearly completely hydrogenated and wherein the 4-Methyl-1H-Benzotriazole is at least 70% hydrogenated.

12. The method according to claim 1 wherein said metallic surface is copper or a copper alloy surface.

13. The method according to claim 1 wherein said hydrogenated benzotriazole composition is a benzotriazole salt.

14. An aqueous composition for practicing the method according to claim 1, comprising between about 0.5–50 ppm benzotriazole, at least a portion of said benzotriazole further comprising hydrogenated benzotriazole, and water.

15. An aqueous composition according to claim 14 wherein said hydrogenated benzotriazole is alkyl or alkoxy substituted.

16. An aqueous composition according to claim 15 wherein said alkyl or alkoxy substitution is selected from the group consisting of methyl, butyl, pentoxy, heptyl, octyl and pentyl.

17. An aqueous composition according to claim 16 wherein said alkyl substitution is methyl.

18. An aqueous composition according to claim 17 wherein said composition contains about 0.5–50 ppm of an admixture of about 60:40 of hydrogenated 5-Methyl-1H-Benzotriazole and 4-Methyl-1H-Benzotriazole, each of which is at least about 50% hydrogenated.

19. An aqueous composition according to claim 18 wherein said composition further contains at least one dissolved ion selected from the group consisting of calcium, magnesium, chloride and sulfate.

20. An aqueous composition according to claim 18 wherein said composition contains between 1–10 ppm of said admixture.

21. An aqueous corrosion inhibiting composition for practicing the method according to claim 1 comprising benzotriazole and water, wherein at least a portion of said benzotriazole further comprises hydrogenated benzotriazole.

* * * * *

UNITED STATES PATENT AND TRADEMARK OFFICE

CERTIFICATE OF CORRECTION

PATENT NO. : 5,874,026

DATED : February 23, 1999

INVENTOR(S) : John P. Pilsits, Jr. et al.

It is certified that error appears in the above-identified patent and that said Letters Patent is hereby corrected as shown below:

Title Page, [56] References Cited, U.S. PATENT DOCUMENTS, insert:

--3,887,481 6/1975 Korpics.....252/394
4,668,474 5/1987 Gill et al.....422/14
5,141,675 8/1992 Vanderpool et al.....252/394
5,156,769 10/1992 Cha et al.....252,395
5,746,947 5/1998 Vanderpool et al.....252/394--.

Signed and Sealed this

Twentieth Day of July, 1999

*Attest:*

*Attesting Officer*

Q. TODD DICKINSON

*Acting Commissioner of Patents and Trademarks*